US008387633B2

(12) United States Patent
Uchino

(10) Patent No.: US 8,387,633 B2
(45) Date of Patent: Mar. 5, 2013

(54) SURFACE TREATMENT EQUIPMENT

(75) Inventor: Masahide Uchino, Tokyo (JP)

(73) Assignee: Japan Field Co., Ltd., Tokyo (JP)

( * ) Notice: Subject to any disclaimer, the term of this patent is extended or adjusted under 35 U.S.C. 154(b) by 426 days.

(21) Appl. No.: 12/595,783

(22) PCT Filed: May 21, 2008

(86) PCT No.: PCT/JP2008/059354
§ 371 (c)(1),
(2), (4) Date: Nov. 6, 2009

(87) PCT Pub. No.: WO2009/001638
PCT Pub. Date: Dec. 31, 2008

(65) Prior Publication Data

US 2010/0126537 A1 May 27, 2010

(30) Foreign Application Priority Data

Jun. 28, 2007 (JP) ..... 2007-170045

(51) Int. Cl.
*B08B 13/00* (2006.01)
*B08B 3/08* (2006.01)

(52) U.S. Cl. ..... 134/117

(58) Field of Classification Search ..... 134/117
See application file for complete search history.

(56) References Cited

FOREIGN PATENT DOCUMENTS

| | | | |
|---|---|---|---|
| JP | 63-24754 | | 5/1988 |
| JP | 4-145988 | * | 5/1992 |
| JP | 09-192621 | * | 7/1997 |
| JP | 1100628 | * | 1/1999 |
| JP | 2002-79196 | | 3/2002 |

OTHER PUBLICATIONS

JP09-192621A—English machine translation.*

* cited by examiner

*Primary Examiner* — Michael Barr
*Assistant Examiner* — Jason Riggleman
(74) *Attorney, Agent, or Firm* — Jordan and Hamburg LLP

(57) ABSTRACT

Surface treatment equipment in which a working mechanism housed in a surface treatment tank is moved up and down while keeping the tank in a vacuum state through use of a series of sealing members positioned relative to the working mechanism, and the working mechanism can be rotated or oscillated, is provided.

3 Claims, 7 Drawing Sheets

SURFACE TREATMENT EQUIPMENT

BACKGROUND OF THE INVENTION

The present invention relates to a surface treatment equipment including a power transmission mechanism allowing a surface treatment cage, storing an object to be processed thereinside for performing surface treatments such as a corrosion-proof, washing, barreling, and plating treatments, to be rotatable and vertically movable in a pressure-resistant tank in a vacuum.

Patent Document 1 discloses a prior art washing equipment washing an object to be washed by rotating and vertically moving in a washing tank thereof. In such a washing equipment, a lower end side of a drive shaft is inserted into the washing tank, and an upper end side of the drive shaft is protruded from the washing tank. Such an upper end side of the drive shaft is connected with a vertical movement mechanism allowing the drive shaft to be vertically movable. A rotation drive mechanism allowing the drive shaft to be rotatably movable is disposed to an upper end of the drive shaft, and a rotation table is disposed to a lower end of the drive shaft through a rotation transmission mechanism transmitting driving force of the drive shaft.

The rotation drive mechanism is operated to rotatably drive the drive shaft while the vertical movement mechanism is operated to vertically move the drive shaft in a state that the object to be washed is secured on the rotation table, so that the object to be washed is rotatable and is movable up and down. Accordingly, the object to be washed rotates and/or moves up and down, so that washing operation is performed. The washing equipment disclosed in the Patent Document 1 is used based on a premise that the inside of the washing tank is at a normal pressure.

On the other hand, in a case where washing operation is performed in a state that the washing tank maintains vacuum thereinside, good effect is obtained as is known. For example, in a case where ultrasonic cleaning is performed in a state that the washing tank is in the vacuum, not only an ultrasonic wave is less attenuated compared to a case of performing the ultrasonic cleaning at the normal pressure, but also a washing effect is enhanced by exhausting the air adhered to an undulated area. Moreover, in a case where objects to be processed contact one another or are placed one on another in the surface treatment operation excluding the washing operation, for example, plating, performed in the vacuum, a surface treatment agent permeates small portions, thereby uniformly performing the surface treatment.

Patent Document 1: Japanese Patent Publication No. S63-24754

SUMMARY OF THE INVENTION

Since the washing equipment disclosed in the above Patent Document 1 is used in a state that the inside of the washing tank is at the normal pressure, the inside of the washing tank is not sealed in a pressure-resistant manner and remains at the normal pressure. Consequently, the washing operation cannot be performed in a vacuum atmosphere using such a washing equipment.

The present invention is proposed in consideration of the aforementioned conventional situations and is intended to provide a surface treatment equipment capable of vertically moving a working mechanism stored inside a surface treatment tank and capable of performing operation such as rotation and oscillation in a working mechanism portion according to a surface treatment object while maintaining a vacuum inside the surface treatment tank.

The present invention is proposed in consideration of the aforementioned conventional situations and includes: a pressure-resistant tank capable of being in a vacuum thereinside; and a pressure-resistant casing, having a cylindrical shape, inserting a lower end side thereof into the pressure-resistant tank while protruding an upper end side thereof outwardly from the pressure-resistant tank and capable of moving vertically by connecting a vertical movement mechanism to a protrusion portion. Such a casing is resistant to the pressure, so that the casing unlikely receives damages, and the equipment can be used in a stable state in a case where the casing is disposed inside the pressure-resistant tank in the vacuum. The pressure-resistant casing may include a pressure-resistant storage unit storing a rotation transmission mechanism (described later) in a lower portion thereof. The vertical movement mechanism may be a hydraulic cylinder or a pneumatic cylinder or may be a screw or a chain block and the like.

Moreover, the present invention includes: a rotation drive mechanism disposed to the protrusion portion of the pressure-resistant casing; a drive shaft, disposed to and penetrating the pressure-resistant casing, capable of rotating by connecting to the rotation drive mechanism; and a working mechanism transmitting driving force of the drive shaft through the rotation transmission mechanism connected to a lower portion of the drive shaft and performing surface treatment operation. The working mechanism may transmit the driving force of the drive shaft to a rotation transmission roller or a transfer chain by coupling a driven shaft including the rotation transmission roller or the transfer chain to the rotation drive mechanism, and may be capable of rotating or oscillating a surface treatment cage placed on the rotation transmission roller or the transfer chain. Moreover, the working mechanism may transmit the driving force of the drive shaft to a rotation table by coupling the driven shaft including the rotation table to the rotation drive mechanism, and may be capable of rotating the surface treatment cage placed on the rotation table. Moreover, the driving force of the drive shaft may be transmitted, and an optional working mechanism may be formed.

Moreover, the present invention includes: a pressure-resistant vacuum sealing member disposed to an outside air communication portion between the pressure-resistant tank and the pressure-resistant casing for maintaining air-tightness inside the pressure-resistant tank by a vertical movement of the pressure-resistant casing; and a drive vacuum sealing member disposed to an outside air communication portion between the pressure-resistant casing and the drive shaft or/and the rotation transmission mechanism for maintaining the air-tightness inside the pressure-resistant tank by rotation of the drive shaft or/and the rotation transmission mechanism. The pressure-resistant vacuum sealing member responding to the vertical movement and the drive vacuum sealing member responding to the rotation are disposed, thereby respectively maintaining the air-tightness in the outside air communication portion between the pressure-resistant tank and the pressure-resistant casing and the outside air communication portion between pressure-resistant casing and the drive shaft or/and the rotation transmission mechanism. Accordingly, each of the vertical movement of the pressure-resistant casing and the rotation of the drive shaft can be performed while maintaining the vacuum inside the pressure-resistant tank.

The pressure-resistant vacuum sealing member maintains the air-tightness in response to the vertical movement of the pressure-resistant casing, and does not respond to the rotation of the drive shaft or/and the rotation transmission mechanism. The drive vacuum sealing member maintains the air-tightness in response to the rotation of the drive shaft or/and the rotation transmission mechanism, and does not respond to the vertical movement of the pressure-resistant casing.

According to the present invention with the structure described above, the pressure-resistant vacuum sealing member is disposed to the outside air communication portion between the pressure-resistant tank and the pressure-resistant casing, so that the pressure-resistant casing and the drive shaft are vertically movable in a state that the outside air communication portion between the pressure-resistant tank and the pressure-resistant casing is sealed. Moreover, the drive vacuum sealing member is disposed to the outside air communication portion between the pressure-resistant casing and the drive shaft or/and the rotation transmission mechanism, so that the drive shaft or/and the rotation transmission mechanism is/are rotatable in a state that the outside air communication portion between the pressure-resistant casing and the drive shaft or/and the rotation transmission mechanism is sealed.

Regarding such sealing, the pressure-resistant vacuum sealing member maintains the air-tightness in response only to the vertical movement of the pressure-resistant casing, and does not respond to a rotation portion including the drive shaft or/and the rotation transmission mechanism. Moreover, the drive vacuum sealing member maintains the air-tightness in response only to the rotation of the drive shaft or/and the rotation transmission mechanism, and does not respond to the vertical movement of the pressure-resistant casing. Therefore, each of the sealing members is not applied with an unreasonable load, thereby obtaining a stable vacuum sealing effect for a prolonged period. As a result, the vertical movement of the pressure-resistant casing and the rotation of the drive shaft or/and the rotation transmission mechanism can be performed individually or simultaneously while maintaining the vacuum inside the pressure-resistant tank.

According to the present invention, therefore, a rotation surface treatment operation and a vertical movement surface treatment operation are simultaneously or individually performed while maintaining the vacuum inside the pressure-resistant tank, thereby expanding application of a surface treatment method in the vacuum and further enhancing a surface treatment effect. For example, a washing effect can be further enhanced by an increase in physical force in the washing operation.

DETAILED DESCRIPTION OF THE INVENTION

Embodiment 1

Figure 1:
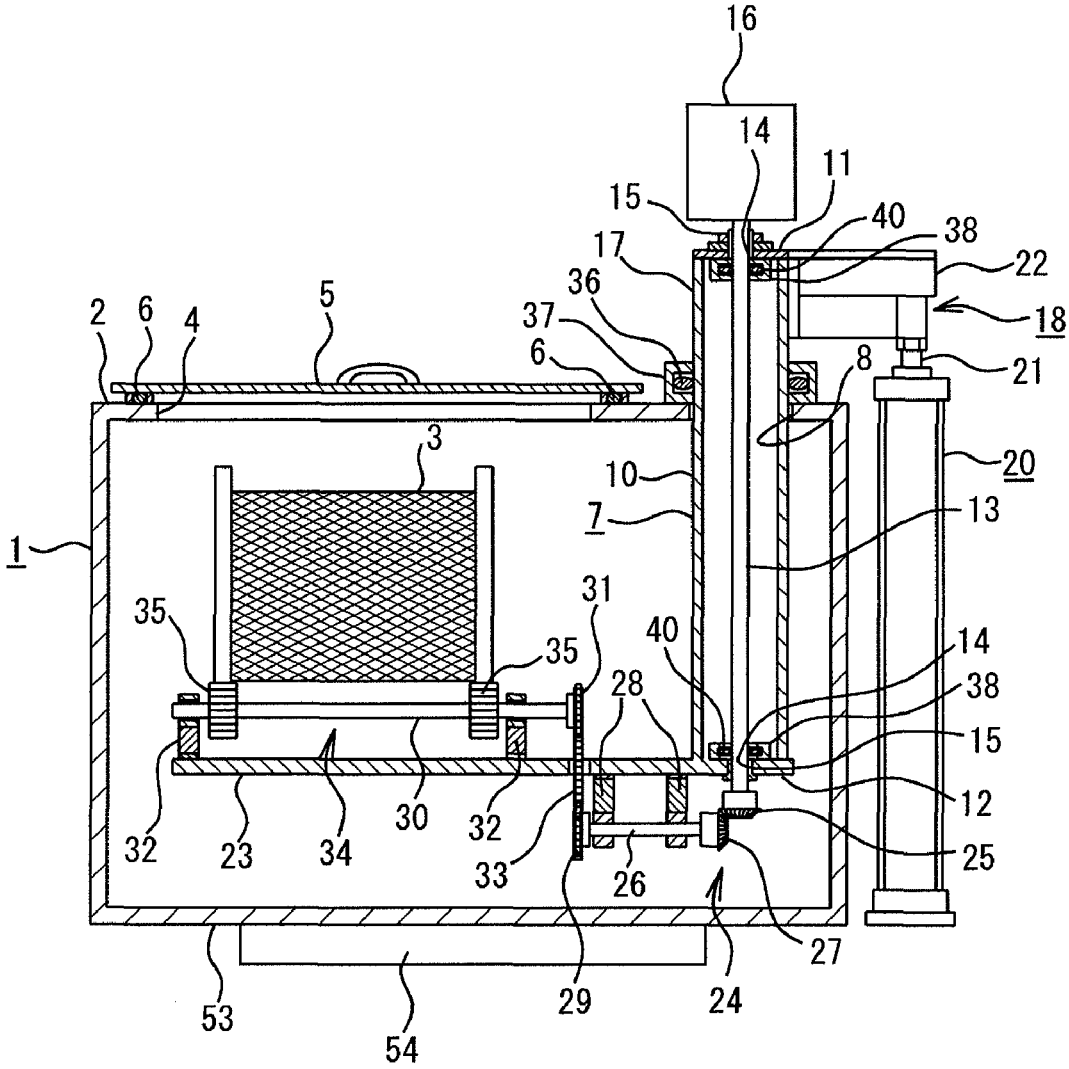
FIG. 1 is a cross-sectional view illustrating a surface treatment equipment according to a first embodiment of the present invention.
Figure 2:
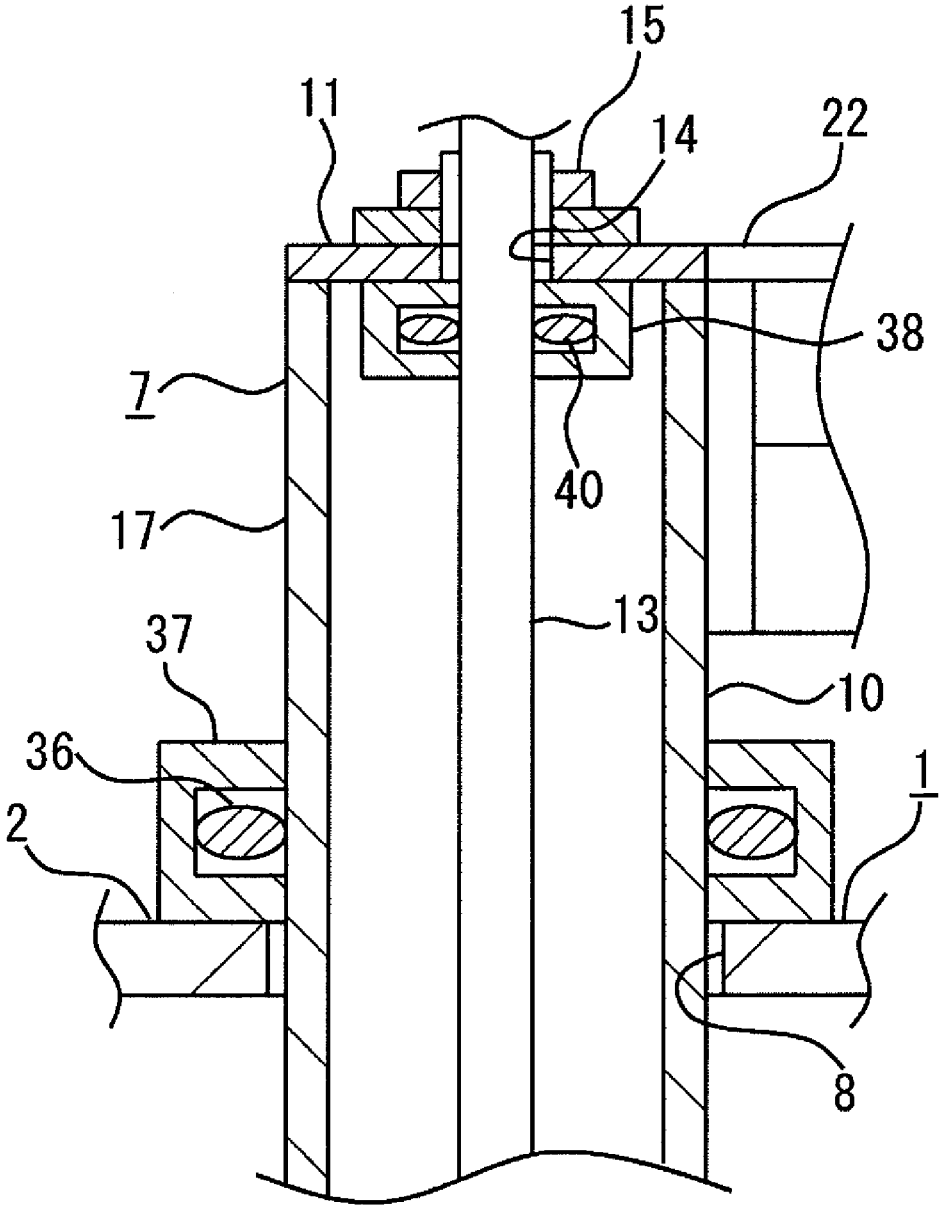
FIG. 2 is an enlarged cross-sectional view partially illustrating the surface treatment equipment of FIG. 1.
Figure 3:
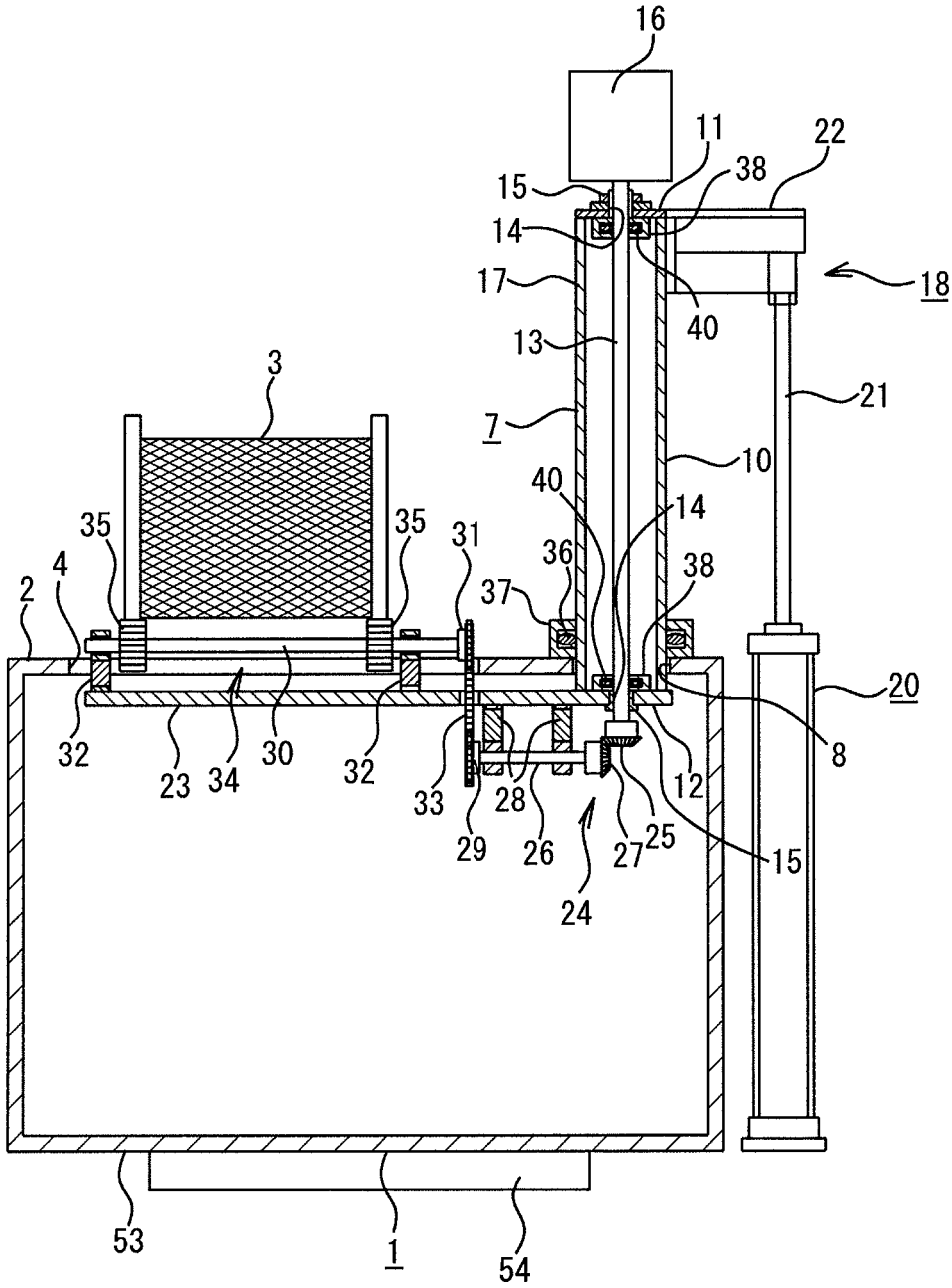
FIG. 3 is a cross-sectional view illustrating the surface treatment equipment of FIG. 1 in a state that a cylinder rod is moved upwardly.

A detailed description is given of a first embodiment of the present invention with reference to FIG. 1 through FIG. 3. As illustrated in FIG. 1, a reference numeral "1" represents a pressure-resistant tank. An opening 4 is disposed to a top board 2 of the pressure-resistant tank 1, and a cover 5 is disposed on the opening 4 through which a surface treatment cage 3 is passable. A sealing member 6 having soft elasticity is disposed to a bottom surface of the cover 5 or an upper portion of the top board 2. The sealing member 6 allows space between the opening 4 and the cover 5 to be sealable in a case where the pressure inside the pressure-resistant tank 1 is reduced.

An insertion opening 8 is disposed to the top board 2 of the pressure-resistant tank 1 and allows a pressure-resistant casing 7 having a cylindrical shape to be insertable therethrough. The pressure-resistant casing 7 is inserted through the insertion opening 8, and a lower end thereof is slidably disposed inside the pressure-resistant tank 1. The pressure-resistant casing 7 includes a top wall 11 and a bottom wall 12 respectively disposed to an upper end and a lower end of a peripheral wall 10 having a cylindrical shape, and an upper end side thereof is protruded outwardly from the pressure-resistant tank 1.

A drive shaft 13 is penetratingly disposed to the pressure-resistant casing 7 in such a manner as to be rotatable and not to be vertically slidable. That is, each of the top wall 11 and the bottom wall 12 of the pressure-resistant casing 7 includes an insertion hole 14 allowing the drive shaft 13 to be insertable therethrough, and the drive shaft 13 is inserted into the insertion holes 14 through bearings 15. An upper end and a lower end of the drive shaft 13 penetrate outwardly from the respective top wall 11 and bottom wall 12 of the pressure-resistant casing 7.

A rotation drive mechanism 16 including an electric motor to rotate the drive shaft 13 is disposed to the upper end of the drive shaft 13. In the pressure-resistant casing 7, a protrusion portion 17 protruded outwardly from the pressure-resistant tank 1 is connected with a vertical movement mechanism 18 allowing the pressure-resistant casing 7 to make a vertical movement. The vertical movement mechanism 18 is a hydraulic cylinder 20, and a cylinder rod 21 of the hydraulic cylinder 20 is connectively secured to the protrusion portion 17 of the pressure-resistant casing 7 through a connection member 22.

The vertical movement mechanism 18 is operated to vertically move the cylinder rod 21, so that the pressure-resistant casing 7 is allowed to make the vertical movement. Such a vertical movement of the pressure-resistant casing 7 allows the drive shaft 13 to make a vertical movement. Herein, the hydraulic cylinder 20 serves as the vertical movement mechanism 18 according to the embodiment. However, a pneumatic cylinder, a screw, or a chain block, and the like may be used as the vertical movement mechanism in a different embodiment. A support board 23 is protrusively disposed to the bottom wall 12 of the pressure-resistant casing 7 in a horizontal direction.

The lower end of the drive shaft 13 is connected with a rotation transmission mechanism 24. Herein, the rotation transmission mechanism 24 is described in detail. The rotation transmission mechanism 24 includes a drive rotation transmission gear 25 formed of a bevel gear disposed to the lower end of the drive shaft 13. The drive rotation transmission gear 25 is engaged with a driven rotation transmission gear 27 formed of a bevel gear of a first driven shaft 26. The first driven shaft 26 is rotatably disposed to a pair of first support arms 28 in a horizontal direction, and the first support arms 28 are protrusively disposed to a bottom surface of the support board 23. The driven rotation transmission gear 27 is disposed to one end of the first driven shaft 26 on the side close to the drive shaft 13. A first sprocket 29 is disposed to another end of the first driven shaft 26.

A second sprocket 31 disposed to one end of a second driven shaft 30 is disposed above the first sprocket 29 of the first drive shaft 13 through the support board 23. The second driven shaft 30 is rotatably disposed in the horizontal direction and to a pair of second support arms 32 standing on an upper surface of the support board 23. The second driven shaft 30 allows the second sprocket 31 of the second driven shaft 30 and the first sprocket 29 of the first driven shaft 26 to be coupled by a rotation transmission chain 33.

The rotation transmission mechanism 24 is connected with a working mechanism 34 transmitting the driving force of the drive shaft 13 through the rotation transmission mechanism 24 and performing the surface treatment operation. The working mechanism 34 allows a pair of rotation transmission rollers 35 to be secured to outer circumference of the second driven shaft 30 with an interval between the rotation transmission rollers 35, and is formed by placing the surface treatment cage 3 on the pair of rotation transmission rollers 35. The surface treatment cage 3 is rotated by rotation of the rotation transmission rollers 35, thereby performing the surface treatment operation on the object to be processed placed inside the surface treatment cage 3. For example, the surface treatment cage 3 serves as a cage storing the object to be washed and is used as a washing equipment for the object to be washed.

As illustrated in FIG. 2, an annular pressure-resistant portion housing 37 having an annular pressure-resistant vacuum sealing member 36 disposed thereinside is closely secured along the insertion opening 8 in an outer circumferential position of the pressure-resistant casing 7 on an upper surface of the pressure-resistant tank 1. An inner circumferential surface and an outer circumferential surface of the pressure-resistant vacuum sealing member 36 disposed inside the pressure-resistant housing 37 are respectively disposed to an outer circumferential surface of the pressure-resistant casing 7 and an inner circumferential surface of pressure-resistant housing 37 in a close contact manner, so that the outside air communication portion between the pressure-resistant tank 1 and the pressure-resistant casing 7 is sealed, thereby maintaining the air-tightness inside the pressure-resistant tank 1 in the outside air communication portion. The pressure-resistant vacuum sealing member 36 maintains the air-tightness in response to the vertical movement of the pressure-resistant casing 7. The pressure-resistant vacuum sealing member 36 does not necessarily respond to a rotation portion (described later), thereby having a light load and capable of stably maintaining the air-tightness for a prolonged period.

As illustrated in FIG. 1, annular drive portion housings 38 are closely secured to respective top and bottom surfaces of the pressure-resistant casing 7 along the insertion holes 14, and are disposed to the outer circumference of the drive shaft 13 in the pressure-resistant casing 7. As illustrated in FIG. 1 and FIG. 2, annular drive vacuum sealing members 40 are disposed inside the drive portion housings 38. An inner circumferential surface and an outer circumferential surface of each of the drive vacuum sealing members 40 are respectively disposed to the outer circumferential surface of the drive shaft 13 and the inner circumferential surface of the drive portion housing 38 in a close contact manner, so that the outside air communication portions between the pressure-resistant casing 7 and the drive shaft 13 are sealed, thereby maintaining the air-tightness inside the pressure-resistant tank 1 in the outside air communication portions. Since the drive shaft 13 does not make any vertical movement relative to the pressure-resistant casing 7, the drive vacuum sealing members 40 can maintain the air-tightness in response only to the rotation of the drive shaft 13 and do not necessarily respond to the vertical movement, thereby having a light load and capable of stably maintaining the air-tightness for a prolonged period.

According to the embodiment described above, the drive vacuum sealing members 40 are disposed to the respective top and bottom surfaces of the pressure-resistant casing 7, thereby stably maintaining high air-tightness. However, the drive vacuum sealing member 40 may be disposed to one of the top or bottom surfaces of the pressure-resistant casing 7 in a different embodiment. Consequently, a sealing effect may be obtained at a low cost.

A description is now given of the washing operation in the vacuum atmosphere in a case where the surface treatment cage 3 is used as a washing cage for the object to be washed according to the above structure. The cover 5 of the pressure-resistant tank 1 is removed, and the vertical movement mechanism 18 is operated to upwardly move the cylinder rod 21 of the hydraulic cylinder 20 and the pressure-resistant casing 7, so that the second driven shaft 30 is disposed to the opening 4 as illustrated in FIG. 3. The surface treatment cage 3, serving as the washing cage, having the object to be washed stored thereinside is placed on the rotation transmission rollers 35 of the second driven shaft 30.

Subsequently, the vertical movement mechanism 18 is operated to downwardly move the cylinder rod 21 and the pressure-resistant casing 7, so that the surface treatment cage 3 is disposed inside the pressure-resistant tank 1. Next, washing solution is imported inside the pressure-resistant tank 1. Herein, the opening 4 of the pressure-resistant tank 1 is covered with the cover 5 and is sealed as illustrated in FIG. 1, and the pressure-resistant tank 1 reduces the pressure thereinside by operation of a pressure reduction mechanism (not shown).

Herein, the outside air communication portion between the pressure-resistant tank 1 and the pressure-resistant casing 7 is sealed by the pressure-resistant vacuum sealing member 36 as described above, and the outside air communication portions between the pressure-resistant casing 7 and the drive shaft 13 have been sealed, thereby allowing the inside of the pressure-resistant tank 1 to be in the vacuum. The pressure-resistant tank 1 maintains the vacuum thereinside, so that the washing solution is deaerated. For example, in a case where an ultrasonic oscillator 54 is disposed to a bottom portion of the pressure-resistant tank, and ultrasonic cleaning is performed, not only the ultrasonic wave is less attenuated compared to a case of performing the ultrasonic cleaning at the normal pressure, but also a washing effect can be enhanced by exhausting the air adhered to a small undulated area of the object to be washed to have good contact with the washing solution.

Accordingly, the rotation drive mechanism 16 is operated to rotate the drive shaft 13, so that the first driven shaft 26 is rotated through the drive rotation transmission gear 25 and the driven rotation transmission gear 27. The rotation of the first driven shaft 26 allows the first sprocket 29 of the first driven shaft 26 to rotate, so that the second sprocket 31 of the second driven shaft 30 is rotated through the rotation transmission chain 33. Therefore, the second driven shaft 30 is rotated in the same direction as the first driven shaft 26, and the pair of rotation transmission rollers 35 disposed to the second driven shaft 30 is rotated.

The rotation of the rotation transmission rollers 35 allows the surface treatment cage 3 serving as the washing cage to rotate, thereby performing the washing operation on the object to be washed in the surface treatment cage 3. Therefore, in a case where the drive shaft 13 is rotated, the outside air communication portions between the pressure-resistant casing 7 and the drive shaft 13 are sealed by the drive vacuum sealing members 40, thereby maintaining the vacuum inside the pressure-resistant tank 1. Since the drive shaft 13 does not make the vertical movement relative to the pressure-resistant casing 7, the drive vacuum sealing members 40 can maintain the air-tightness in response only to the rotation of the drive shaft 13 and do not necessarily respond to the vertical movement of the pressure-resistant casing 7, thereby having a light load and capable of stably maintaining the air-tightness for a prolonged period.

Moreover, the vertical movement mechanism 18 is operated to move the cylinder rod 21 up and down, so that the support board 23 vertically moves with the pressure-resistant casing 7. The surface treatment cage 3 disposed above the support board 23 vertically moves with the vertical movement of the support board 23, and the surface treatment operation is performed on the object to be processed by the vertical movement of the surface treatment cage 3. In a case where the pressure-resistant casing 7 makes the vertical movement, the outside air communication portion between the pressure-resistant tank 1 and the pressure-resistant casing 7 is sealed by the pressure-resistant vacuum sealing member 36, thereby maintaining the vacuum inside the pressure-resistant tank 1. The pressure-resistant vacuum sealing member 36 maintains the air-tightness in response only to the vertical movement of the pressure-resistant casing 7 and does not necessarily respond to the rotation of the drive shaft 13, thereby having a light load and capable of stably maintaining the air-tightness for a prolonged period.

Moreover, in a case where the drive shaft 13 is rotated inside the pressure-resistant tank 1 in the vacuum as described above, the pressure-resistant tank 1 maintains the vacuum thereinside using the drive vacuum sealing members 40. In a case where the pressure-resistant casing 7 makes the vertical movement inside the pressure-resistant tank 1 in the vacuum as described above, the pressure-resistant tank 1 maintains the vacuum thereinside using the pressure-resistant vacuum sealing member 36. Therefore, the rotation surface treatment operation and the vertical movement surface treatment operation can be performed individually. Moreover, in a case where the drive shaft 13 is rotated at the same time as the vertical movement of the drive shaft 13 made by the vertical movement of the pressure-resistant casing 7, the rotation surface treatment operation and the vertical movement surface treatment operation can be performed simultaneously. In a case where the rotation surface treatment operation and the vertical movement surface treatment operation are simultaneously performed, the surface treatment effect can be further enhanced. For example, the washing effect can be further enhanced by an increase in physical power in the washing operation.

Embodiment 2

According to the first embodiment described above, the drive vacuum sealing members 40 are disposed to the respective top wall 11 and bottom wall 12 of the pressure-resistant casing 7. According to a second embodiment, on the other hand, a pressure-resistant storage unit 41 storing a rotation transmission mechanism 24 therein is disposed in a lower end of a pressure-resistant casing 7, and a drive vacuum sealing member 40 is disposed to the pressure-resistant storage unit 41. A detailed description is given of the second embodiment with reference to FIG. 4. The pressure-resistant storage unit 41 stores therein a drive rotation transmission gear 25 of a drive shaft 13, a driven rotation transmission gear 27 of a first driven shaft 26, the first driven shaft 26, a first sprocket 29 of the first driven shaft 26, and a second sprocket 31 of a second driven shaft 30, and is disposed to the lower end of the pressure-resistant casing 7.

The second driven shaft 30 including the second sprocket 31 is disposed in a horizontal direction and protrudes outward from an insertion hole 42 of the pressure-resistant storage unit 41. A support board 23 protruding from the pressure-resistant storage unit 41 is disposed below the second driven shaft 30, and a working mechanism 34 formed substantially the same as the first embodiment is disposed to the support board 23.

Figure 4:
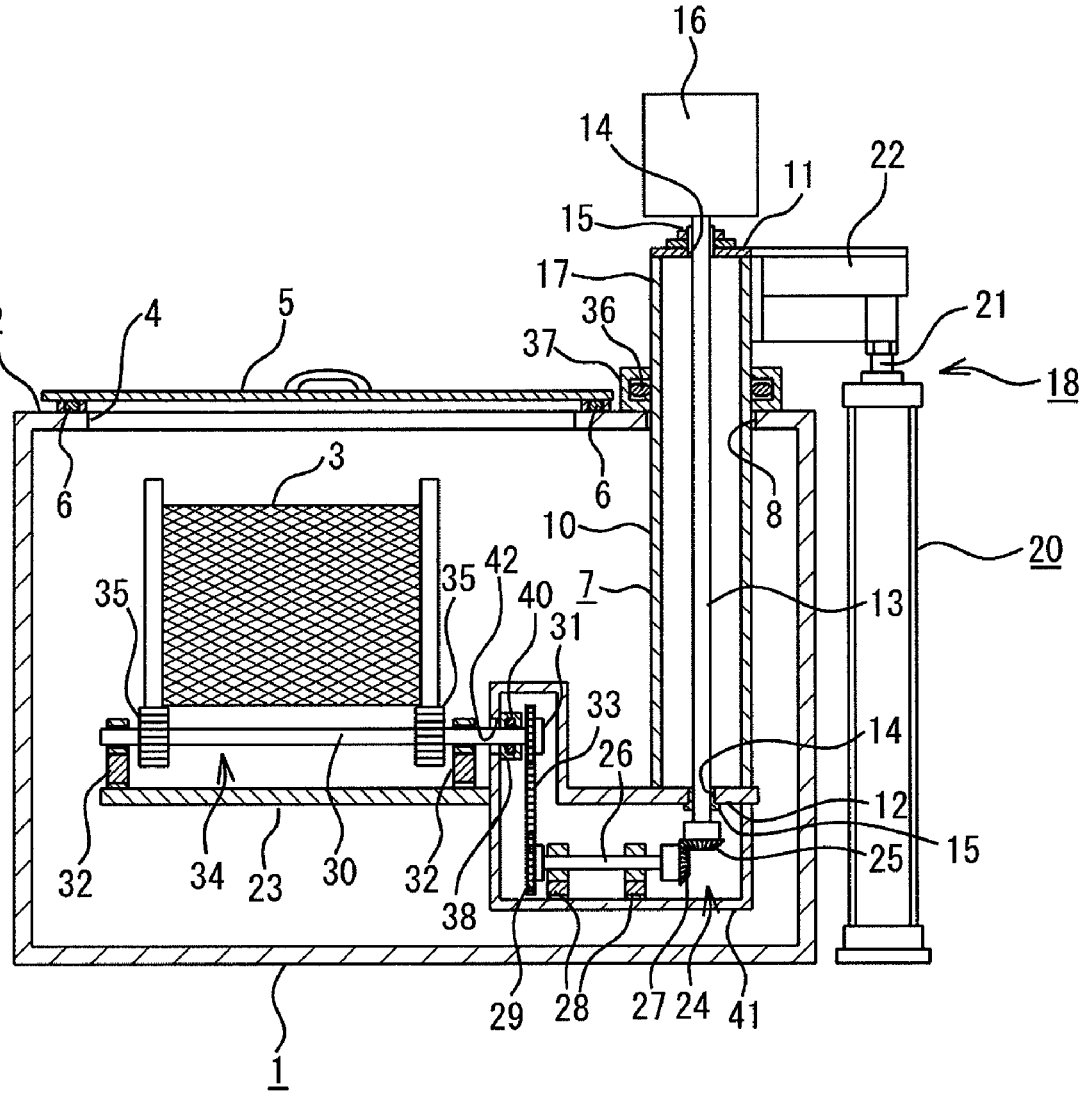
FIG. 4 is a cross-sectional view illustrating a surface treatment equipment according to a second embodiment of the present invention.

In the pressure-resistant storage unit 41 as illustrated in FIG. 4, a drive portion housing 38 having the drive vacuum sealing member 40 disposed thereinside is closely secured to outer circumference of the insertion hole 42, and such a drive portion housing 38 is disposed to outer circumference of the second driven shaft 30. The drive vacuum sealing member 40 disposed inside the drive portion housing 38 is disposed between an inner circumference of the drive portion housing 38 and the outer circumference of the second driven shaft 30, so that an outside air communication portion between the pressure-resistant casing 7 and the rotation transmission mechanism 24 is sealed, thereby capable of maintaining air-tightness inside the pressure-resistant tank 1 in the outside air communication portion.

The drive vacuum sealing member 40 can maintain the air-tightness in response only to the rotation of the rotation transmission mechanism 24, and does not necessarily respond to the vertical movement of the pressure-resistant casing 7, thereby having a light load and capable of stably maintaining the air-tightness for a prolonged period. According to the second embodiment, therefore, in a case where the pressure-resistant casing 7 makes the vertical movement, and in a case where the drive shaft 13 is rotated, the pressure-resistant tank 1 can maintain the vacuum thereinside using a pressure-resistant vacuum sealing member 36 and the drive vacuum sealing member 40, respectively, as similar to the above first embodiment. Therefore, the rotation surface treatment operation and the vertical movement surface treatment operation can be performed individually or simultaneously in the vacuum.

Embodiment 3

Figure 5:
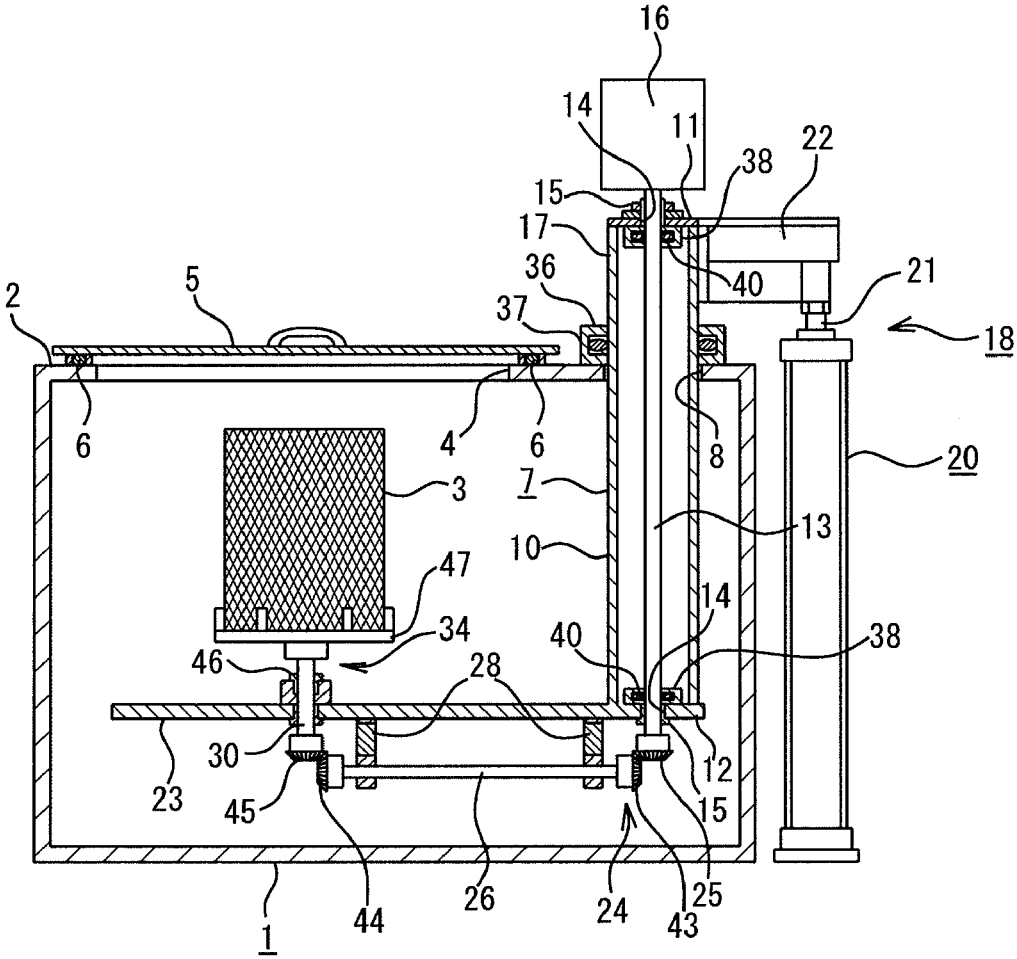
FIG. 5 is a cross-sectional view illustrating a surface treatment equipment according to a third embodiment of the present invention.

According to the first embodiment described above, the surface treatment cage 3 is disposed in the horizontal direction and is rotatable around a horizontal axis by the rotation transmission mechanism 24. According to a third embodiment, on the other hand, a surface treatment cage 3 is disposed in a perpendicular direction and is rotatable around a perpendicular axis by a rotation transmission mechanism 24. A detailed description is given of the third embodiment with reference to FIG. 5. A first driven shaft 26 is disposed below a support board 23 in a horizontal direction, and a pair of driven rotation transmission gears 43, 44 formed of bevel gears is disposed to respective ends of the first driven shaft 26. The driven rotation transmission gear 43 is engaged with a drive rotation transmission gear 25 of the first driven shaft 26 while the driven rotation transmission gear 44 is engaged with a second driven rotation transmission gear 45 disposed below a second driven shaft 30. The second driven shaft 30 is rotatably disposed to and inserted into the support board 23 in the perpendicular direction, and a bearing 46 is interposed between the second driven shaft 30 and the support board 23. A rotation table 47 having a disk shape is disposed to an upper end of the second driven shaft 30, and the surface treatment cage 3 is securely disposed on an upper surface of the rotation table 47 in the perpendicular direction.

Therefore, a rotation drive mechanism 16 is operated to rotate the drive shaft 13, so that the second driven shaft 30 is rotated through the first driven shaft 26. The rotation of the second driven shaft 30 allows the surface treatment cage 3 to rotate around the perpendicular axis with the rotation table 47.

In a case where the drive shaft 13 is rotated, an outside air communication portion between the pressure-resistant casing 7 and the drive shaft 13 is sealed by a drive vacuum sealing member 40, thereby capable of maintaining the air-tightness inside the pressure-resistant tank 1. Therefore, the rotation of the drive shaft 13 allows the surface treatment cage 3 to rotate around the perpendicular axis in a vacuum. Since the drive shaft 13 does not make a vertical movement relative to the pressure-resistant casing 7, the drive vacuum sealing member 40 can maintain the air-tightness in response only to the rotation of the drive shaft 13 and does not necessarily respond to the vertical movement of the pressure-resistant casing 7, thereby having a light load and capable of stably maintaining the air-tightness for a prolonged period.

Embodiment 4

According to the first and second embodiments described above, the rotation transmission rollers 35 are disposed to the second driven shaft 30, and the surface treatment cage 3 is placed on the rotation transmission rollers 35, so that the surface treatment cage 3 can be rotated by the rotation of the rotation transmission rollers 35. According to a fourth embodiment, on the other hand, a transfer chain 48 is disposed to a second driven shaft 30, and a surface treatment cage 3 is placed on the transfer chain 48, so that the surface treatment cage 3 is oscillatable in a horizontal direction.

Figure 6:
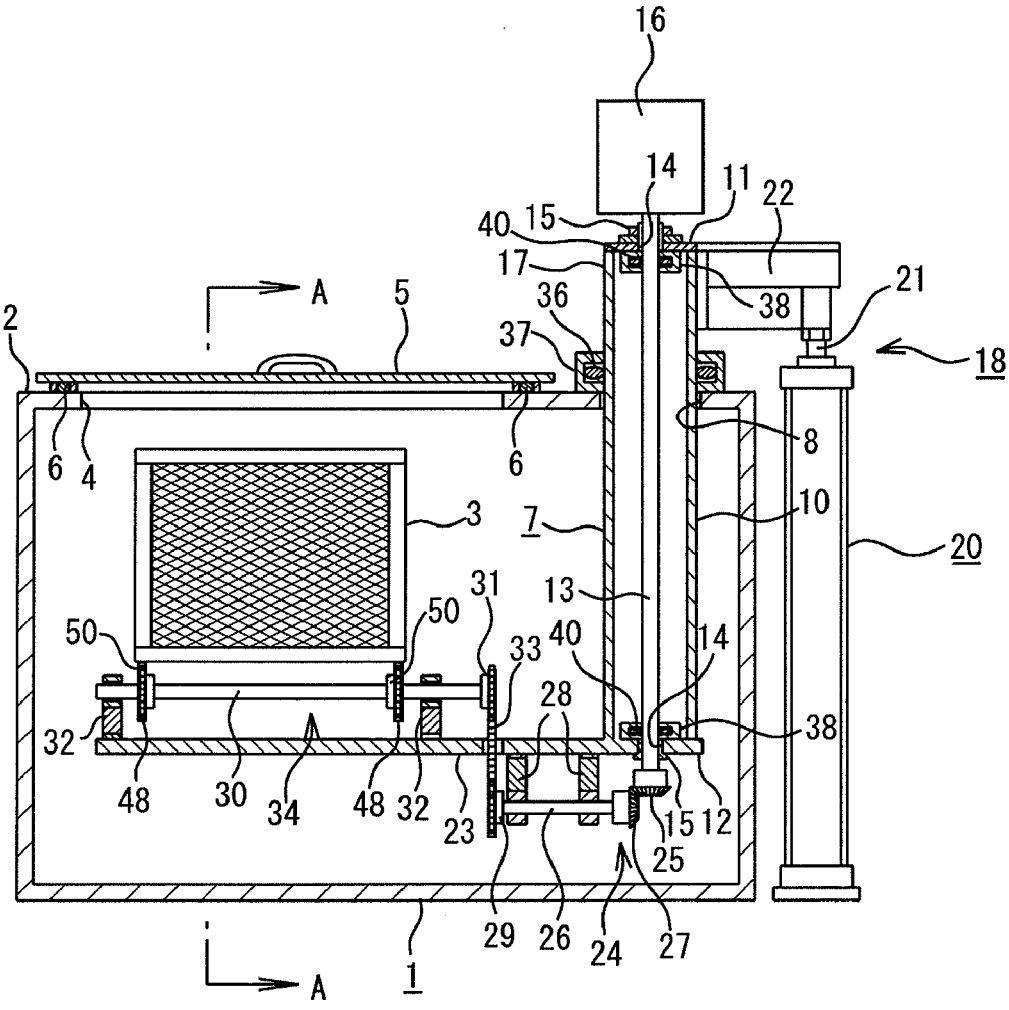
FIG. 6 is another cross-sectional view illustrating a surface treatment equipment according to a fourth embodiment of the present invention.
Figure 7:
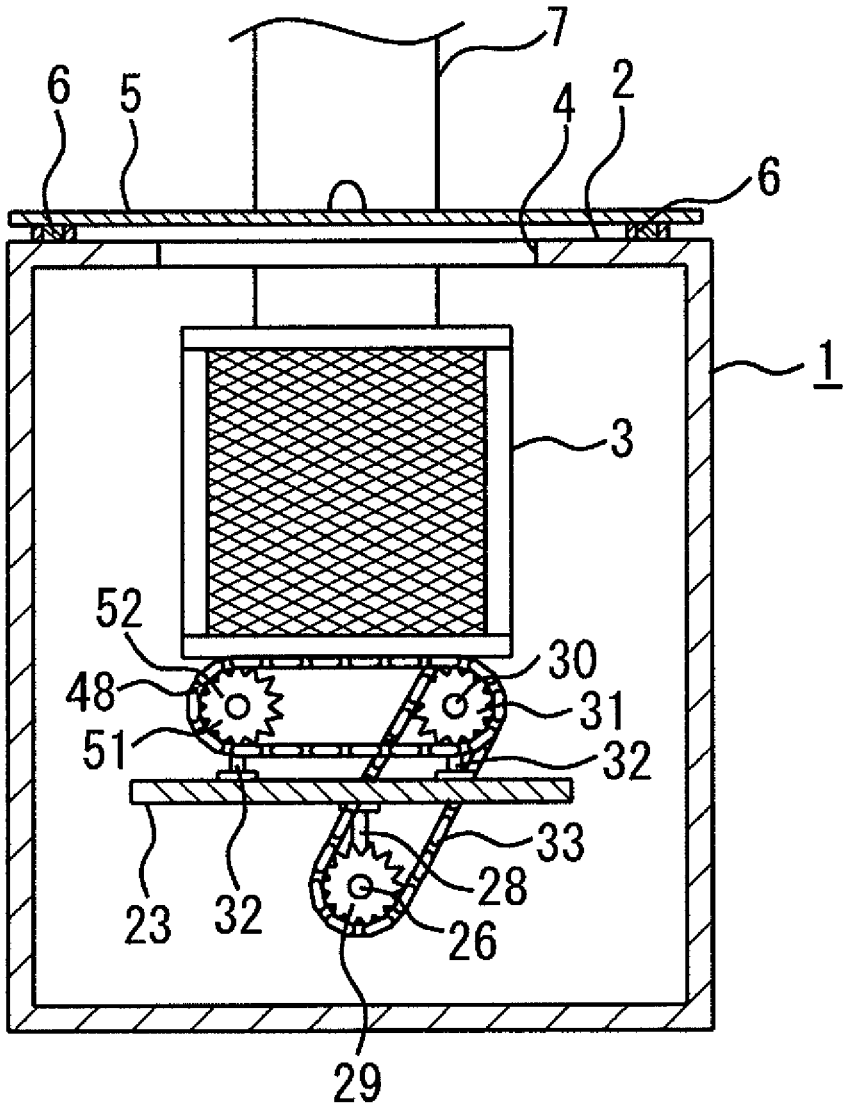
FIG. 7 is a cross-sectional view illustrating the surface treatment equipment taken along the line A-A of FIG. 6.

A detailed description is now given of the fourth embodiment with reference to FIG. 6 and FIG. 7. The second driven shaft 30 includes a pair of transfer sprockets 50 disposed thereto. As illustrated in FIG. 7, an auxiliary shaft 51 is disposed parallel to the second driven shaft 30 above a support board 23. As similar to the driven shaft 30, the auxiliary shaft 51 includes a pair of transfer sprockets 52 disposed thereto. The transfer sprockets 50 of the second driven shaft 30 and the transfer sprockets 52 of the auxiliary shaft 51 are coupled by a respective pair of transfer chains 48.

As illustrated in FIG. 6, the surface treatment cage 3 is placed on the pair of transfer chains 48, and a rotation drive mechanism 16 is operated to rotate the drive shaft 13 little by little in an opposite direction. Accordingly, the transfer chains 48 are rotated little by little in the opposite direction through the first and second driven shafts 26 and 30, so that the surface treatment cage 3 oscillates in the horizontal direction. Therefore, the surface treatment operation is performed on an object to be processed inside the surface treatment cage 3 by oscillating the surface treatment cage 3.

In a case where the drive shaft 13 is rotated, an outside air communication portion between the pressure-resistant casing 7 and the drive shaft 13 is sealed by a drive vacuum sealing member 40, thereby capable of maintaining the air-tightness inside the pressure-resistant tank 1. The rotation of the drive shaft 13 allows the surface treatment cage 3 to oscillate in the vacuum. Since the drive shaft 13 does not make the vertical movement relative to the pressure-resistant casing 7, the drive vacuum sealing member 40 can maintain the air-tightness in response only to the rotation of the drive shaft 13 and does not necessarily respond to the vertical movement of the pressure-resistant casing 7, thereby having a light load and capable of stably maintaining the air-tightness for a prolonged period.

According to the fourth embodiment, in a case where the pressure-resistant casing 7 makes the vertical movement, and in a case where the drive shaft 13 is rotated, the pressure-resistant tank 1 can maintains the vacuum thereinside using a pressure-resistant vacuum sealing member 36 and the drive vacuum sealing member 40, respectively, as similar to the above first and second embodiments. Therefore, the rotation surface treatment operation and the vertical movement surface treatment operation can be performed individually or simultaneously in the vacuum.

What is claimed is:

1. A pressure-resistant surface treatment equipment being sealed from atmospheric pressure so as to enable said pressure resistance, said equipment comprising:

a pressure-resistant tank capable of being in a vacuum thereinside;

a pressure-resistant casing, having a cylindrical shape and including a top wall at a top end thereof and a bottom wall at a bottom end thereof, inserting a lower end side thereof into the pressure-resistant tank while protruding an upper end side thereof outwardly from the pressure-resistant tank and capable of moving vertically by integrally connecting a vertical movement mechanism to adjacent the upper end side of the pressure-resistant casing;

a rotation drive mechanism disposed adjacent the upper end side of the pressure-resistant casing so as to protrude outwardly from the pressure-resistant casing and the pressure-resistant tank;

a drive shaft penetrating the pressure-resistant casing, and which is capable of rotating by connecting to the rotation drive mechanism;

a pressure-resistant storage unit that receives a bottom portion of the drive shaft and that is fixed to a bottom portion of the pressure-resistant casing;

a working mechanism transmitting driving force of the drive shaft to a connected first driven shaft of a rotation transmission mechanism stored in the pressure-resistant storage unit to a second driven shaft for performing a surface treatment operation;

a pressure-resistant vacuum sealing member adjacent a first outside air communication portion positioned between the pressure-resistant tank and the pressure-resistant casing for maintaining air-tightness inside the pressure-resistant tank throughout vertical movement of the pressure-resistant casing, the pressure-resistant vacuum sealing member being disposed within a pressure-resistant housing portion adhered to the pressure-resistant tank on a top face thereof and adjacent the first air communication portion, said pressure-resistant vacuum sealing member being positioned against an outer circumferential face of the pressure-resistant casing and within the pressure-resistant housing portion so that an outer circumferential face of the pressure-resistant sealing member is in close contact with an inner circumferential face of pressure-resistant housing and an inner circumferential face of the pressure-resistant housing is in close contact with an outer circumferential face of the pressure-resistant casing; and a drive vacuum sealing member adjacent a second outside air communication portion positioned between the pressure-resistant casing and the rotation transmission mechanism for maintaining the air-tightness inside the pressure-resistant tank throughout rotation of the drive shaft, an inner circumferential face of the drive vacuum sealing member being in close contact with an outer circumferential surface of the second driven shaft one end of which is inserted within a drive housing portion storing the drive vacuum sealing member, the drive housing portion being disposed adjacent the second outside air communication portion, and an outer circumferential face of the drive vacuum sealing member being in close contact with an inner face of the drive housing portion.

2. The surface treatment equipment according to claim 1, wherein the working mechanism transmits the driving force of the drive shaft to a rotation transmission roller or a transfer chain by coupling the second driven shaft, that includes the rotation transmission roller or the transfer chain, to the rotation drive mechanism, and is capable of rotating or oscillating the surface treatment cage placed on the rotation transmission roller or the transfer chain.

3. The surface treatment equipment according to claim 1, wherein the working mechanism transmits the driving force of the drive shaft to a rotation table by coupling the second driven shaft, that includes the rotation table, to the rotation drive mechanism, and is capable of rotating the surface treatment cage placed on the rotation table.

* * * * *